US007127839B2

(12) United States Patent
Pessayre et al.

(10) Patent No.: US 7,127,839 B2
(45) Date of Patent: Oct. 31, 2006

(54) IRON INCLUDING AN ADDITIVE RESERVOIR

(75) Inventors: Stèphanie Pessayre, Corbas (FR); Jean Louis Compeau, St. Quentin Fallavier (FR); Bertrand Couet, Loire sur Rhone (FR)

(73) Assignee: SEB S.A., Ecully (FR)

( * ) Notice: Subject to any disclaimer, the term of this patent is extended or adjusted under 35 U.S.C. 154(b) by 0 days.

(21) Appl. No.: 11/094,696

(22) Filed: Mar. 31, 2005

(65) Prior Publication Data

US 2005/0217152 A1 Oct. 6, 2005

(30) Foreign Application Priority Data

Apr. 1, 2004 (FR) ..... 04 03438

(51) Int. Cl.
*D06F 75/22* (2006.01)
*D06F 75/08* (2006.01)

(52) U.S. Cl. ..... 38/77.1

(58) Field of Classification Search ..... 38/77.5, 38/77.6, 77.8, 77.82, 77.83; 210/282; 423/321.1; 239/274

See application file for complete search history.

(56) References Cited

U.S. PATENT DOCUMENTS 4,844,885 A * 7/1989 Chernack ..... 424/61
5,526,595 A * 6/1996 Daulasim et al. ..... 38/77.8
6,163,990 A * 12/2000 Urata et al. ..... 38/77.8
6,625,910 B1 * 9/2003 Ching et al. ..... 38/77.3
6,951,836 B1 * 10/2005 Jahns et al. ..... 510/441

FOREIGN PATENT DOCUMENTS

| | | | |
|---|---|---|---|
| EP | 0 039 441 AA | | 11/1981 |
| EP | 0 554 166 A | | 8/1993 |
| EP | 557901 | * | 9/1993 |
| EP | 1 443 058 A | | 8/2004 |
| FR | 1 334 918 A | | 8/1963 |
| FR | 2 548 046 A | | 1/1985 |
| FR | 2632331 A1 | * | 12/1989 |
| FR | 2 804 137 A | | 7/2001 |

* cited by examiner

*Primary Examiner*—Ismael Izaguirre
(74) *Attorney, Agent, or Firm*—Browdy and Neimark, PLLC

(57) ABSTRACT

An iron including an additive reservoir and a device for spreading the additive onto an article. The reservoir contains at least one additive packaged in the form of microcapsules in suspension in a liquid, the microcapsules having membranes made of a material that is chemically compatible with the materials of the device used for spreading the additive.

22 Claims, 4 Drawing Sheets

IRON INCLUDING AN ADDITIVE RESERVOIR

BACKGROUND OF THE INVENTION

The present invention relates to a clothes pressing iron and more particularly to an iron that includes a device for supplying an additive to articles being ironed.

Patent documents FR 2 804 137 and EP 0 554 166 disclose irons that include an additive reservoir associated with a spray device enabling an additive to be sprayed onto articles being ironed in order to supply a fragrance, improve the sliding behavior of the iron, or improve properties of the article, e.g. in order to soften it or improve its strength.

In order to be usable with such spreading, or spraying, devices, the additive must possess a viscosity that is compatible with the spreader device, must be chemically neutral relative to the materials of the spreader device, and in particular relative to the reservoir, and should preferably be soluble and concentratable in water. Such constraints present the drawback of considerably restricting the choice of additive and excluding otherwise more effective additives.

In addition, when the additive used is a fragrance, spraying the fragrance on the article leads also to strong diffusion of the fragrance into the atmosphere, which can lead to the atmosphere becoming fragrant with an intensity that can be disagreeable to those present.

BRIEF SUMMARY OF THE INVENTION

Thus, the present invention provides an iron constructed to remedy those drawbacks.

To this end, the iron according to the invention has a reservoir containing an additive, and includes a device for spreading, or spraying, the additive on the article being ironed. The iron according to the invention is characterized in that the reservoir contains at least one additive packaged in the form of microcapsules in suspension in a liquid, the microcapsules being composed of membranes made of a material that is chemically compatible with the materials of the device used for spreading the additive. Each membrane encapsulates a small quantity of the additive.

The term "chemically compatible" is used to designate a material that does not perceptibly degrade the materials of the device for spreading additives over the lifetime of the iron.

Micro-encapsulation of the additive presents the advantage of eliminating direct contact between the additive and the elements of the device for spreading the additive, thereby making it possible to reduce problems of chemical attack or clogging associated with the nature of the additive.

In addition, micro-encapsulating the additive makes it possible, without adding any additional agent, to use additives that are insoluble in water, and that are not suitable for being concentrated or diluted in order to be spread on articles under good conditions.

Micro-encapsulating the additive also makes it possible, without using an emulsifier, to prepare suspensions that are homogenous and stable with an equivalent concentration of additive lying in the range >0 to 45% by weight, while conserving a viscosity that is very low and suitable for all delivery systems.

When using an additive that is sensitive to a rise in temperature, such as essential oils, micro-encapsulation also presents the advantage of preventing the additive from losing its effectiveness when the additive reservoir is subjected to high temperatures following an ironing session.

Finally, micro-encapsulating the additive presents the advantage of preventing the additive from diffusing into the atmosphere while being spread by the device. This prevents the user from inhaling the additive while using the device.

According to another characteristic of the iron of the invention, the microcapsules are in suspension in water.

The water which is then used for conveying the microcapsules also presents the advantage of dampening the article being ironed, thereby making ironing easier.

According to another characteristic of the iron of invention, the additive contained in the microcapsules consists of or comprises a fragrance.

According to another characteristic of the iron of invention, the additive contained in the microcapsules consists of or comprises an anti-odor active substance such as undecylenic acid.

According to another characteristic of the iron of the invention, the liquid in which the microcapsules are in suspension itself contains an additive of a type other than that contained in the microcapsules, such as an additive suitable for improving sliding of the iron.

Such a characteristic presents the advantage of enabling additives to be obtained that have two effects, a first effect that is immediate, associated with the additive contained in the liquid carrying the microcapsules, and a second effect that is delayed, associated with the additive contained in the microcapsules.

According to another characteristic of the iron of the invention, the device for spreading the additive on articles is a spray device.

Such a device presents the advantage of being simple and well suited to the use of a micro-encapsulated additive, given that the micro-encapsulation of the additive makes it possible to avoid excessive diffusion of the additive into the atmosphere during spraying.

According to another characteristic of the iron of the invention, the spray device comprises a nozzle fed by a pump.

According to another characteristic of the iron of the invention, the iron is a steam iron and the spray device is a sprayer using the driving force of steam.

Such a characteristic presents the advantage of enabling a powerful spray to be obtained at low cost, with micro-encapsulation of the additive making it possible to limit to a very great extent the amount of additive that is emitted into the atmosphere as an inherent result of spraying.

According to another characteristic of the iron of the invention, the reservoir of the iron is removable from the iron.

Such a characteristic makes it easy to fill the reservoir or to exchange it quickly with another reservoir.

The invention also provides for a removable reservoir for fitting to an iron as described above, the reservoir being characterized in that it contains at least one additive packaged in the form of microcapsules in suspension in a liquid, the microcapsules having membranes made of a material that is chemically compatible with the materials of the reservoir.

An iron according to the invention can, of course, be used to perform any ironing operation.

BRIEF DESCRIPTION OF THE DRAWING

The objects, aspects, and advantages of the present invention will be better understood from the following description of particular embodiments of the invention given as non-limiting examples, and with reference to the accompanying drawings, in which.

Only those elements that are necessary for understanding the invention are shown. To make the drawings easier to read, when the same elements appear in more than one figure, they are given the same reference characters.

DETAILED DESCRIPTION OF THE INVENTION

Figure 1:
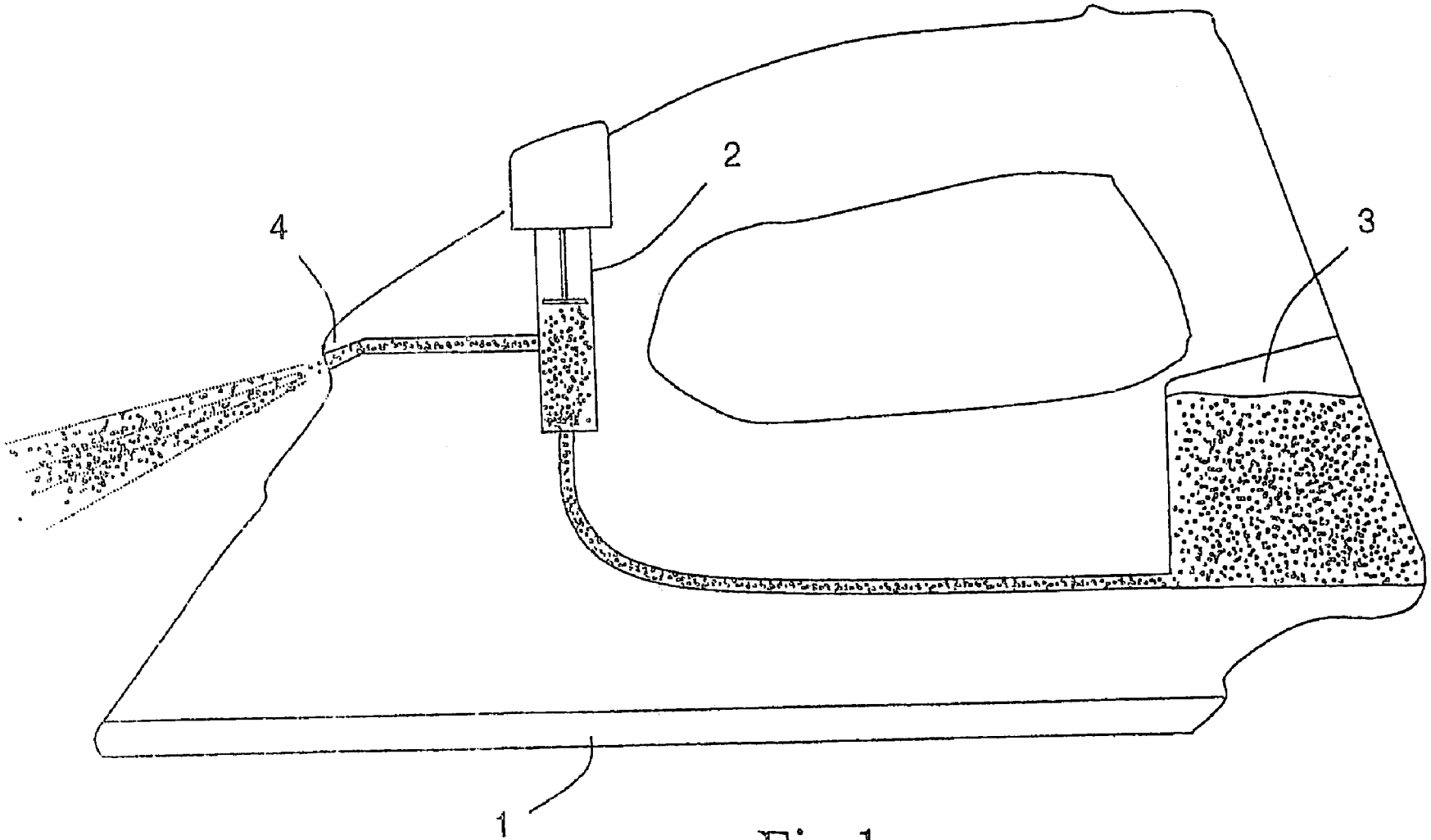
FIG. 1 is a general elevational view of an iron fitted with an additive reservoir according to a first embodiment of the invention.

FIG. 1 shows a steam iron conventionally comprising a hot soleplate 1 and a steam chamber fed from a main reservoir that is not shown in the figure.

The iron also has a spray device comprising a piston pump 2 fed from an additive reservoir 3 and connected to a spray nozzle 4. The additive reservoir 3 is preferably in the form of a cassette that is removably mounted on the body of the iron.

More particularly, in the invention, additive reservoir 3 contains microcapsules in suspension in a liquid, the microcapsules containing an additive. These microcapsules are preferably constituted by capsules having polymeric walls and having a diameter of a few micrometers, and they are prepared using a method that is known in itself, for example using one of the methods described in French patents FR 1 334 918 and FR 2 548 046.

Figure 4:
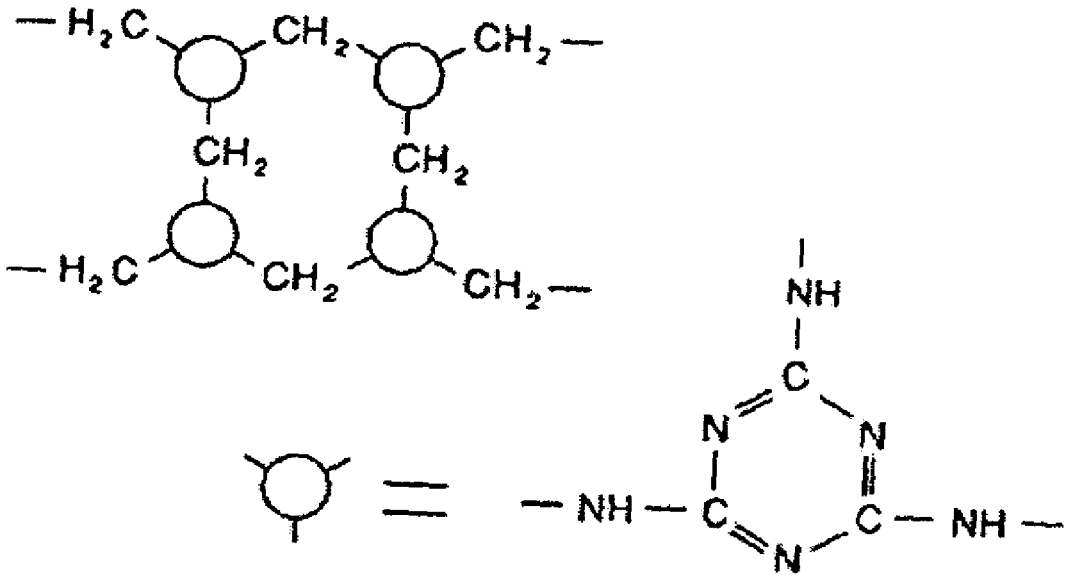
FIG. 4 is a diagram showing the chemical structure of a membrane material used in the practice of the present invention.

By way of example, the membranes constituting the walls of the microcapsules can be made of melamine-formaldehyde so as to be chemically inert relative to plastics materials of the polypropylene type from which the spray device, and in particular the additive reservoir, are conventionally made. For example, the membrane material may be hexamethylolmelamine formed by a polycondensation reaction of melamine and formaldehyde. The final hardened state of this composition will have a three dimensional formation having the form shown in FIG. 4.

Advantageously, the microcapsules may contain a fragrance and the liquid in which they are in suspension is water. Thus, when the user actuates pump 2, water and microcapsules from reservoir 3 are sprayed through nozzle 4 and are thus deposited on the fibers of the article being ironed.

Such spraying takes place with little dispersion of the fragrance into the atmosphere, since the fragrance remains contained in the microcapsules. The fragrance in the microcapsules is released into the material of the article when the microcapsule membranes are broken, either when mechanical stress is applied thereto, e.g. by passing the iron over the microcapsules or by handling the article, or else progressively over time, with the main mode of release being easily selected as a function of the size of the capsules and as a function of their wall thickness. The force necessary to break the membranes depends primarily on the size of the microcapsules, the nature of the membrane material and the ambient humidity level. The smaller the microcapsules, the greater the force needed to rupture the membranes. The microcapsule size can vary between 1 μm with 1 mm. Preferably, according to the present invention, the size is between 1 μm and 2 μm and the thickness of the capsule membranes is approximately 0.1 μm to 0.2 μm. The materials used for the membranes may resist attack by the perfumes or may be porous. The lower the ambient humidity, the more fragile are microcapsules. In the presence of steam or other moisture, the microcapsules are less likely to be broken by passage of the iron, while even gentle rubbing of dry fabric will be sufficient to break them.

Such an iron in which the spray pump is fed with a micro-encapsulated fragrance thus presents the advantage of enabling a fragrance to be applied to an article while it is being ironed in a manner that is simple and fast, while avoiding excessive release of fragrance into the atmosphere so that applying the fragrance remains pleasant for the user.

Micro-encapsulating the fragrance also keeps the fragrance contained in the reservoir from losing its strength, particularly under the effect of a high temperature in the reservoir when the iron is in use.

Such use of a micro-encapsulated fragrance also presents the advantage of making it possible to use a wide variety of fragrances, and in particular fragrances that, if they were not encapsulated, would degrade the spray device, and in particular the walls of the reservoir.

Finally, micro-encapsulating the fragrance makes it possible to delay diffusion of the fragrance, and the diffusion and remanance parameters can be modified by modifying the size and the wall thickness of the capsules.

In a variant embodiment, the microcapsules in suspension in the liquid may contain a known antibacterial or anti-odor active principle, such as undecylenic acid ($CH_2{=}CH(CH_2)_8COOH$). This additive may be associated with a fragrance in such a manner as to apply a fragrance to the article while simultaneously impregnating the article with the anti-odor additive.

Such a variant embodiment presents the advantage of making it possible, by performing an operation that is simple and fast, to apply an anti-odor active principle whose action over time will be prolonged by progressive release of the active principle in the article as the microcapsules are progressively ruptured during handling of the article.

In another variant embodiment, the liquid in which the additive microcapsules are contained in the reservoir could itself contain an additive, preferably different from the additive contained in the microcapsules, such that the additive contained in the reservoir and the additive contained in the microcapsules enable two separate effects to be obtained.

By way of example, the liquid, such as water, in which the microcapsules are in suspension could contain silicone in order to enhance sliding of the iron, as described in European patent application EP 1 201 818.

In this variant, the water containing the silicone additive is sprayed directly onto the article, making it possible to obtain an immediate improvement in the sliding of the iron. Conversely, the additive contained in the microcapsules projected by the spray pump is released only progressively during passage of the iron or while the article is being handled.

This is made possible by appropriately selecting the liquid carrying the microcapsules, the material of the microcapsules, and the additive, which remain immiscible.

A device is thus obtained for spraying additives having two effects: an immediate effect associated with the additive contained in the liquid carrying the microcapsules, and a deferred effect associated with the additive contained in the microcapsules.

In another variant embodiment, the microcapsules in suspension in the liquid of the reservoir could contain different types of additive. Thus, certain microcapsules in the reservoir might contain fragrance, while other microcapsules might contain an anti-odor or antibacterial active principle, or any other substance. Microcapsules containing more than two different types of additive could also be provided.

Figure 2:
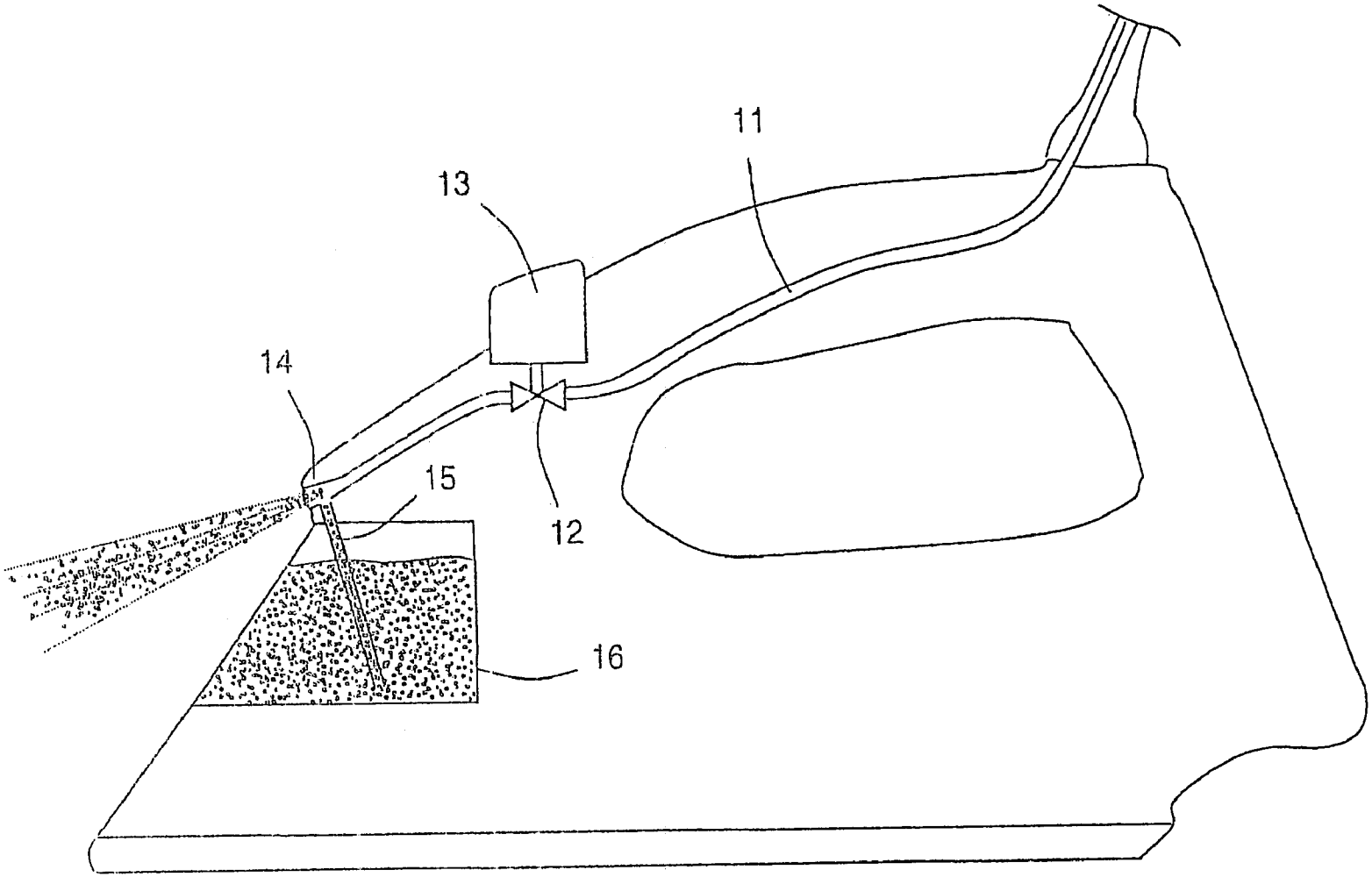
FIG. 2 is a view similar to that of FIG. 1 showing an embodiment of the invention as an iron associated with an external steam generator.

FIG. 2 shows an application of the invention to a smoothing iron associated with an external steam generator (not shown in the figure).

In FIG. 2, the iron has a steam feed hose, or tube, 11 supplying steam under pressure to a spray device comprising a valve 12 controlled by a pushbutton 13 and a spray nozzle 14 disposed at the front of the iron.

Spray nozzle 14 is fed with steam through valve 12 and includes a Venturi into which there opens one end of a tube 15 that is housed in an additive reservoir 16 located under nozzle 14. The opposite, inlet, end of tube 15 is positioned near the bottom of reservoir 16. Reservoir 16 is preferably in the form of a removable cassette, and in accordance with the invention it contains at least one additive packaged in microcapsules that are in suspension in a liquid.

The liquid supporting, or suspending, the microcapsules, and the additive contained in the microcapsules, are advantageously selected from various examples described above, although other types of additives can also be employed according to the invention.

The operation of the spray device of the iron is described below.

When the user seeks to apply fragrance to an article, a reservoir 16 is inserted into the front of the iron, the reservoir containing microcapsules of fragrance in suspension in a liquid, which may consist of water, or water with another ingredient, or a non-aqueous liquid. By pressing on button 13 that controls valve 12, the user causes the steam produced by the steam generator and supplied via tube 11 to pass through nozzle 14 and escape into the atmosphere. The flow of steam as created in this way sucks up the water together with the microcapsules located in the tube 15 by the Venturi effect, so that the liquid and the microcapsules contained in the reservoir 16 are propelled onto the article by the steam.

Such a spray device using the driving force of steam presents the advantage of being powerful, inexpensive, and particularly advantageous when it is used in combination with a micro-encapsulated additive. Packaging the additive in capsules makes it possible to significantly reduce the dispersive effect inherent in such a steam spray device. It then becomes possible to apply fragrance to articles without that leading to excessive fragrance being released into the ambient air.

Figure 3:
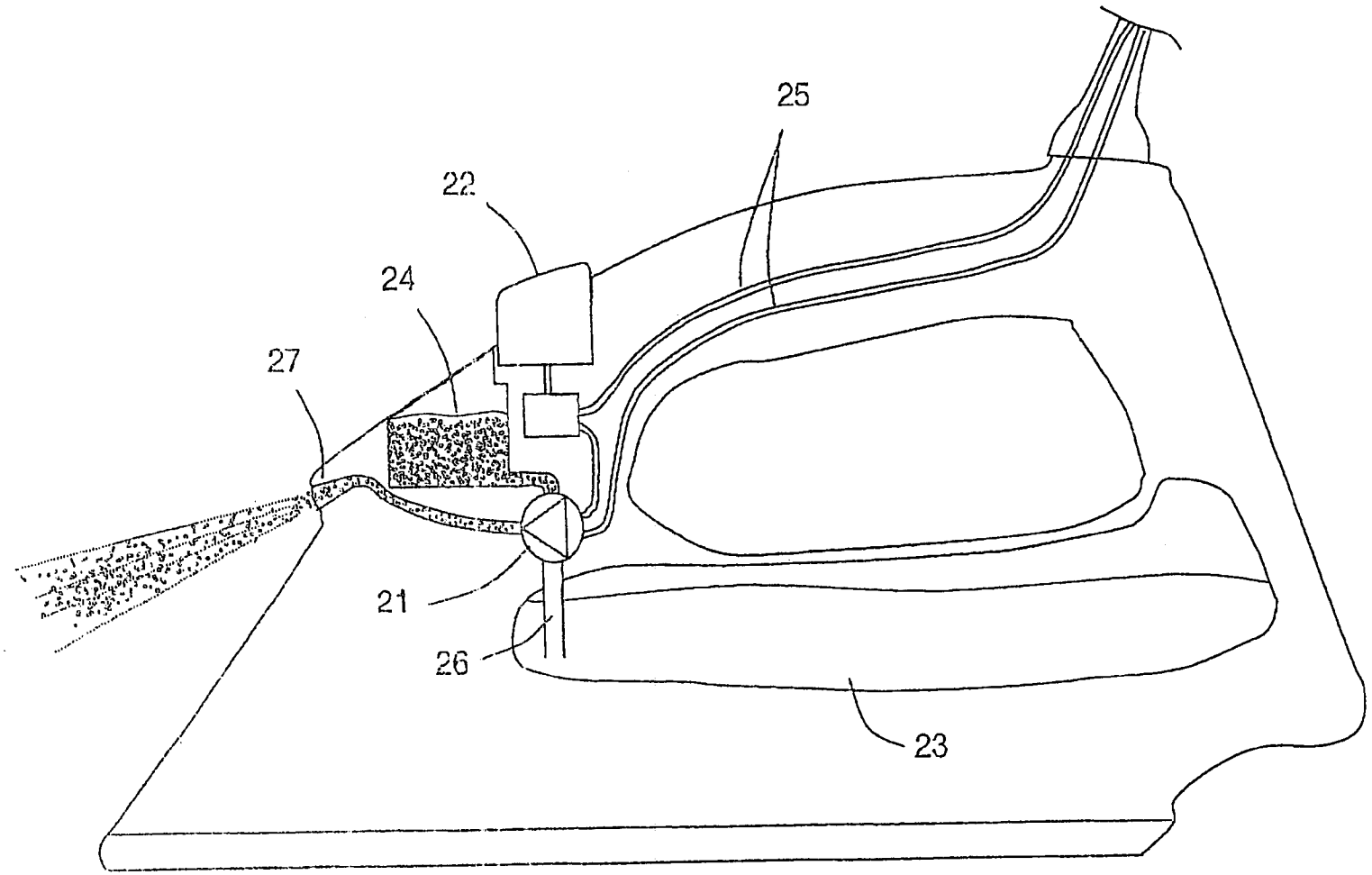
FIG. 3 is a view similar to that of FIG. 1 showing an embodiment of the invention applied as an iron including another additive delivery system.

FIG. 3 shows the invention applied to a smoothing steam iron that has a delivery system in which the additive is diluted in a delivery device prior to being sprayed on the article.

As shown in this figure, the iron has an electric pump 21 controlled by a pushbutton 22, a main water reservoir 23 for feeding a steam chamber (not shown in the figure) that communicates with steam outlet holes in the iron soleplate, and a preferably removable additive reservoir 24 placed on the front top portion of the body of the iron.

Electrical power is supplied to pump 21 by two wires 25 connected to the power mains. As shown, one of these wires is connected to an on/off switch that is operated by depressing pushbutton 22, and pump 21 has two fluid inlets connected respectively to additive reservoir 24 and to a tube 26 extending into main water reservoir 23. Pump 21 has a mixing chamber in which water coming from main reservoir 23 is mixed with the liquid coming from additive reservoir 24 and pump 21 further has an outlet connected to one end of a tube, or conduit, whose other end is connected to a spray nozzle 27.

In this embodiment, the microcapsules contained in the additive reservoir are present in a high concentration, thus enabling an equivalent concentration of additive to be obtained that is of the order of 20% by weight, or even more. The additive contained in the microcapsules is advantageously selected from the various examples described above.

When the user seeks to treat an article, or articles, with additive, pressing on button 22 closes an electric switch to set pump 21 into operation. Pump 21 then sucks in water from main reservoir 23 and also liquid together with microcapsules from additive reservoir 24, after which it delivers the resulting mixture, in which the additive is diluted in the water, to spray nozzle 27.

In such an embodiment, the use of a micro-encapsulated additive presents the advantage of enabling the additive to be highly concentrated in the reservoir, while retaining low viscosity that is well suited to a conventional pumping device. The high concentration of additive thus makes it possible to use an additive reservoir of small capacity, which is thus compact and easy to handle.

Naturally, the invention is not limited in any way to the embodiments described and shown which are given purely by way of example. Modifications remain possible, particularly concerning the structure of the various elements or by substituting with technical equivalents, without thereby going beyond the field of protection of the invention.

For example, in a further embodiment (not shown), the micro-encapsulated additive can be introduced directly into the reservoir feeding the steam chamber of the iron, so that the microcapsules are disposed on the article through the steam outlet holes in the soleplate. In this embodiment, micro-encapsulating the additive presents the advantage of protecting the coating of the steam chamber against possible chemical attack by the additive. Micro-encapsulation also makes it possible to protect the additive from thermal shock, thus enabling the additive to retain its integrity until it reaches the article.

This application relates to subject matter disclosed in French Application number FR 04 03438, filed on Apr. 1, 2004, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An iron comprising: a reservoir for an additive; a device for spreading the additive on an article being ironed; a body of liquid stored in said reservoir; and a plurality of microcapsules containing at least one additive held in said body of liquid, wherein said microcapsules comprise membranes made of a material that is chemically compatible with the materials of said device for spreading the additive.

2. The iron according to claim 1, wherein the liquid is water and said microcapsules are suspended in the water.

3. The iron according to claim 2, wherein said at least one additive contained in said microcapsules comprises a fragrance.

4. The iron according to claim 3, wherein said at least one additive contained in the microcapsules comprises an anti-odor active principle.

5. The iron according to claim 4, wherein said anti-odor active principle is undecylenic acid.

6. The iron according to a claim 4, comprising a second additive in said body of liquid, said second additive being of a type different from that of said additive contained in said microcapsules.

7. The iron according to a claim 6, wherein said second additive is a substance suitable for improving sliding of said iron.

8. The iron according to claim 6, wherein said device for spreading the additive is a spray device.

9. The iron according to claim 8, wherein said spray device comprises a nozzle fed by a pump.

10. The iron according to claim 8, wherein said iron is a steam iron and said spray device produces a spray using the driving force of steam.

11. The iron according to claim 10, wherein said reservoir is removable from said iron.

12. The iron according to claim 1, wherein said device for spreading the additive is a spray device.

13. The iron according to claim 12, wherein said spray device comprises a nozzle fed by a pump.

14. The iron according to claim 12, wherein said iron is a steam iron and said spray device produces a spray using the driving force of steam.

15. The iron according to claim 14, wherein said reservoir is removable from said iron.

16. A removable reservoir for fitting to an iron that includes a device for spreading an additive, wherein said reservoir contains at least one additive packaged in the form of microcapsules in suspension in a liquid, the microcapsules comprising membranes made of a material that is chemically compatible with the materials of the reservoir.

17. The reservoir according to claim 16, wherein said at least one additive contained in said microcapsules comprises a fragrance.

18. The reservoir according to claim 16, wherein said at least one additive contained in the microcapsules comprises an anti-odor active principle.

19. The reservoir according to a claim 16, comprising a second additive in the liquid, said second additive being of a type different from that of said additive contained in said microcapsules.

20. The reservoir according to a claim 19, wherein said second additive is a substance suitable for improving sliding of said iron.

21. The iron according to claim 1 wherein the material of said membranes is selected to prevent contact between said additive and said device for spreading the additive.

22. The reservoir according to claim 16 wherein the material of said membranes is selected to prevent contact between said additive and said device for spreading the additive.

* * * * *